US009340042B1

(12) United States Patent
Zengo et al.

(10) Patent No.: US 9,340,042 B1
(45) Date of Patent: May 17, 2016

(54) DRYING DEVICE, PRINTING APPARATUS AND COMPUTER READABLE MEDIUM

(71) Applicant: FUJI XEROX CO., LTD., Tokyo (JP)

(72) Inventors: Takeshi Zengo, Kanagawa (JP); Takuma Ishihara, Kanagawa (JP); Akira Sakamoto, Kanagawa (JP); Yukari Motosugi, Kanagawa (JP); Jun Isozaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/683,216

(22) Filed: Apr. 10, 2015

(30) Foreign Application Priority Data

Dec. 26, 2014 (JP) ..... 2014-265489

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 11/002; B41J 11/005
See application file for complete search history.

(56) References Cited

U.S. PATENT DOCUMENTS 5,784,090 A * 7/1998 Selensky ..... B41J 11/002 347/102
7,510,277 B2 * 3/2009 Konno ..... B41J 2/155 347/101
2001/0052920 A1 * 12/2001 Matsumoto ..... B41J 11/002 347/102
2009/0244236 A1 * 10/2009 Houjou ..... B41J 11/002 347/102
2013/0195534 A1 * 8/2013 Oohara et al. ..... 399/406
2013/0257964 A1 * 10/2013 Itogawa ..... B41J 13/009 347/16

FOREIGN PATENT DOCUMENTS

JP H10-171202 6/1998
JP 2012-155126 8/2012
JP 2014-083762 5/2014

OTHER PUBLICATIONS

Abstract and machine translation of JP2014-083762.
Abstract and machine translation of JP2012-155126.
Abstract and machine translation of JP H10-171202.

* cited by examiner

*Primary Examiner* — Stephen Meier
*Assistant Examiner* — John P Zimmermann
(74) *Attorney, Agent, or Firm* — Fildes & Outland, P.C.

(57) ABSTRACT

A drying device includes: an irradiation unit that irradiates, with laser light, a printing medium onto which ink droplets have been ejected from a droplets ejecting unit; and a control unit that controls the irradiation unit so that a temperature of ink on the printing medium becomes an ink target temperature that is determined using a thermal deformation temperature of the printing medium as a reference in case the thermal deformation temperature of the printing medium is lower than or equal to an ink drying temperature, and becomes an ink target temperature that is determined using the ink drying temperature as a reference in case the thermal deformation temperature of the printing medium is higher than the ink drying temperature.

11 Claims, 10 Drawing Sheets

FIG. 5

| JIS ABBREVIATION | RESIN NAME | | COMMON HEAT PROOF TEMPERATURE (°C) |
|---|---|---|---|
| PE | POLYETHYLENE | LOW-DENSITY POLYETHYLENE | 70~90 |
| | | HIGH-DENSITY POLYETHYLENE | 90~110 |
| PP | POLYPROPYLENE | | 100~110 |
| PVC | VINYL CHROLIDE RESIN (POLY(VINYL CHLORIDE)) | | 60~80 |
| PS | POLYSTYRENE | POLYSTYRENE | 70~90 |
| | (STYROL RESIN) | FOAMED POLYSTYRENE | 70~90 |
| PET | POLY(ETHYLENE TEREPHTHALATE) (PET RESIN) | | ORIENTED FILM: ~200 |
| | | | NON-ORIENTED FILM: ~60 |
| | | | HEAT-RESISTANT BOTTLE: ~85 |

FIG. 6A

120A

| INK TYPE | DRYING TEMPERATURE (°C) |
|---|---|
| TYPE A | 72 |
| TYPE B | 99 |
| TYPE C | 100 |
| TYPE D | 101 |
| TYPE E | 105 |

FIG. 6B

120B

| PRINTING MEDIUM TYPE | THERMAL DEFORMATION TEMPERATURE (°C) |
|---|---|
| TYPE a | 70 |
| TYPE b | 80 |
| TYPE c | 100 |
| TYPE d | 120 |
| TYPE e | 150 |

FIG. 7A

130A

100°C IRRADIATION PROFILE

UNIT: J/cm²

| ROW NO. (SHEET WIDTH DIRECTION) | COLUMN NO. (CONVEYING DIRECTION) 1 | 2 | 3 | 4 | 5 | 6 | 7 | 8 | 9 | 10 | 11 | 12 | 13 | TOTAL |
|---|---|---|---|---|---|---|---|---|---|---|---|---|---|---|
| 1 | 0 | 0 | 0 | 0 | 0 | 0 | 0 | 0 | 0 | 0 | 0 | 0 | 0 | 0 |
| 2 | 0 | 0 | 0 | 0 | 0 | 0 | 0 | 0 | 0 | 0 | 0 | 0 | 0 | 0 |
| 3 | 1.5 | 0 | 0.1 | 0 | 0.1 | 0 | 0 | 0 | 0 | 0 | 0 | 0 | 0 | 1.7 |
| 4 | 1.5 | 0 | 0.1 | 0 | 0.1 | 0 | 0 | 0 | 0 | 0 | 0 | 0 | 0 | 1.7 |
| 5 | 1.5 | 0 | 0.1 | 0 | 0.1 | 0 | 0 | 0 | 0 | 0 | 0 | 0 | 0 | 1.7 |
| 6 | 1.5 | 0 | 0.1 | 0 | 0.1 | 0 | 0 | 0 | 0 | 0 | 0 | 0 | 0 | 1.7 |
| 7 | 1.5 | 0 | 0.1 | 0 | 0.1 | 0 | 0 | 0 | 0 | 0 | 0 | 0 | 0 | 1.7 |
| 8 | 1.5 | 0 | 0.1 | 0 | 0.1 | 0 | 0 | 0 | 0 | 0 | 0 | 0 | 0 | 1.7 |
| 9 | 1.5 | 0 | 0.1 | 0 | 0.1 | 0 | 0 | 0 | 0 | 0 | 0 | 0 | 0 | 1.7 |
| 10 | 1.5 | 0 | 0.1 | 0 | 0.1 | 0 | 0 | 0 | 0 | 0 | 0 | 0 | 0 | 1.7 |
| 11 | 1.5 | 0 | 0.1 | 0 | 0.1 | 0 | 0 | 0 | 0 | 0 | 0 | 0 | 0 | 1.7 |
| 12 | 1.5 | 0 | 0.1 | 0 | 0.1 | 0 | 0 | 0 | 0 | 0 | 0 | 0 | 0 | 1.7 |
| 13 | 1.5 | 0 | 0.1 | 0 | 0.1 | 0 | 0 | 0 | 0 | 0 | 0 | 0 | 0 | 1.7 |
| 14 | 0 | 0 | 0 | 0 | 0 | 0 | 0 | 0 | 0 | 0 | 0 | 0 | 0 | 0 |
| 15 | 0 | 0 | 0 | 0 | 0 | 0 | 0 | 0 | 0 | 0 | 0 | 0 | 0 | 0 |
| 16 | 0 | 0 | 0 | 0 | 0 | 0 | 0 | 0 | 0 | 0 | 0 | 0 | 0 | 0 |

FIG. 7B

130B

70°C IRRADIATION PROFILE

UNIT: J/cm²

| ROW NO. (SHEET WIDTH DIRECTION) | COLUMN NO. (CONVEYING DIRECTION) 1 | 2 | 3 | 4 | 5 | 6 | 7 | 8 | 9 | 10 | 11 | 12 | 13 | TOTAL |
|---|---|---|---|---|---|---|---|---|---|---|---|---|---|---|
| 1 | 0 | 0 | 0 | 0 | 0 | 0 | 0 | 0 | 0 | 0 | 0 | 0 | 0 | 0 |
| 2 | 0 | 0 | 0 | 0 | 0 | 0 | 0 | 0 | 0 | 0 | 0 | 0 | 0 | 0 |
| 3 | 0.7 | 0.1 | 0.1 | 0.1 | 0.1 | 0.1 | 0.1 | 0.1 | 0.1 | 0.1 | 0.1 | 0.1 | 0 | 1.8 |
| 4 | 0.7 | 0.1 | 0.1 | 0.1 | 0.1 | 0.1 | 0.1 | 0.1 | 0.1 | 0.1 | 0.1 | 0.1 | 0 | 1.8 |
| 5 | 0.7 | 0.1 | 0.1 | 0.1 | 0.1 | 0.1 | 0.1 | 0.1 | 0.1 | 0.1 | 0.1 | 0.1 | 0 | 1.8 |
| 6 | 0.7 | 0.1 | 0.1 | 0.1 | 0.1 | 0.1 | 0.1 | 0.1 | 0.1 | 0.1 | 0.1 | 0.1 | 0 | 1.8 |
| 7 | 0.7 | 0.1 | 0.1 | 0.1 | 0.1 | 0.1 | 0.1 | 0.1 | 0.1 | 0.1 | 0.1 | 0.1 | 0 | 1.8 |
| 8 | 0.7 | 0.1 | 0.1 | 0.1 | 0.1 | 0.1 | 0.1 | 0.1 | 0.1 | 0.1 | 0.1 | 0.1 | 0 | 1.8 |
| 9 | 0.7 | 0.1 | 0.1 | 0.1 | 0.1 | 0.1 | 0.1 | 0.1 | 0.1 | 0.1 | 0.1 | 0.1 | 0 | 1.8 |
| 10 | 0.7 | 0.1 | 0.1 | 0.1 | 0.1 | 0.1 | 0.1 | 0.1 | 0.1 | 0.1 | 0.1 | 0.1 | 0 | 1.8 |
| 11 | 0.7 | 0.1 | 0.1 | 0.1 | 0.1 | 0.1 | 0.1 | 0.1 | 0.1 | 0.1 | 0.1 | 0.1 | 0 | 1.8 |
| 12 | 0.7 | 0.1 | 0.1 | 0.1 | 0.1 | 0.1 | 0.1 | 0.1 | 0.1 | 0.1 | 0.1 | 0.1 | 0 | 1.8 |
| 13 | 0.7 | 0.1 | 0.1 | 0.1 | 0.1 | 0.1 | 0.1 | 0.1 | 0.1 | 0.1 | 0.1 | 0.1 | 0 | 1.8 |
| 14 | 0 | 0 | 0 | 0 | 0 | 0 | 0 | 0 | 0 | 0 | 0 | 0 | 0 | 0 |
| 15 | 0 | 0 | 0 | 0 | 0 | 0 | 0 | 0 | 0 | 0 | 0 | 0 | 0 | 0 |
| 16 | 0 | 0 | 0 | 0 | 0 | 0 | 0 | 0 | 0 | 0 | 0 | 0 | 0 | 0 |

DRYING DEVICE, PRINTING APPARATUS AND COMPUTER READABLE MEDIUM

CROSS-REFERENCE TO RELATED APPLICATIONS

This application is based on and claims priority under 35 USC 119 from Japanese Patent Application No. 2014-265489 filed on Dec. 26, 2014.

BACKGROUND

Technical Field

The present invention relates to a drying device, a printing apparatus, and a computer readable medium storing a program causing a computer to function as a control unit of the drying device.

SUMMARY

According to an aspect of the invention, there is provided a drying device comprising: an irradiation unit that irradiates, with laser light, a printing medium onto which ink droplets have been ejected from a droplets ejecting unit; and a control unit that controls the irradiation unit so that the temperature of ink on the printing medium becomes an ink target temperature that is determined using a thermal deformation temperature of the printing medium as a reference if the thermal deformation temperature of the printing medium is lower than or equal to an ink drying temperature, and becomes an ink target temperature that is determined using the ink drying temperature as a reference if the thermal deformation temperature of the printing medium is higher than the ink drying temperature.

BRIEF DESCRIPTION OF THE DRAWINGS

Exemplary embodiments of the present invention will be described in detail based on the following figures, wherein:

FIG. 5 is a table showing thermal deformation temperatures of respective resins for formation of printing media;

FIG. 6A is a table showing example correspondence information in which ink types are correlated with respective drying temperatures;

FIG. 6B is a table showing example correspondence information in which printing medium types are correlated with respective thermal deformation temperatures;

FIG. 7A shows an example laser light irradiation energy profile for an ink target temperature 100° C. in the printing apparatus according to the exemplary embodiments;

FIG. 7B shows an example laser light irradiation energy profile for an ink target temperature 70° C. in the printing apparatus according to the exemplary embodiments;

DESCRIPTION OF SYMBOLS

Figure 1:
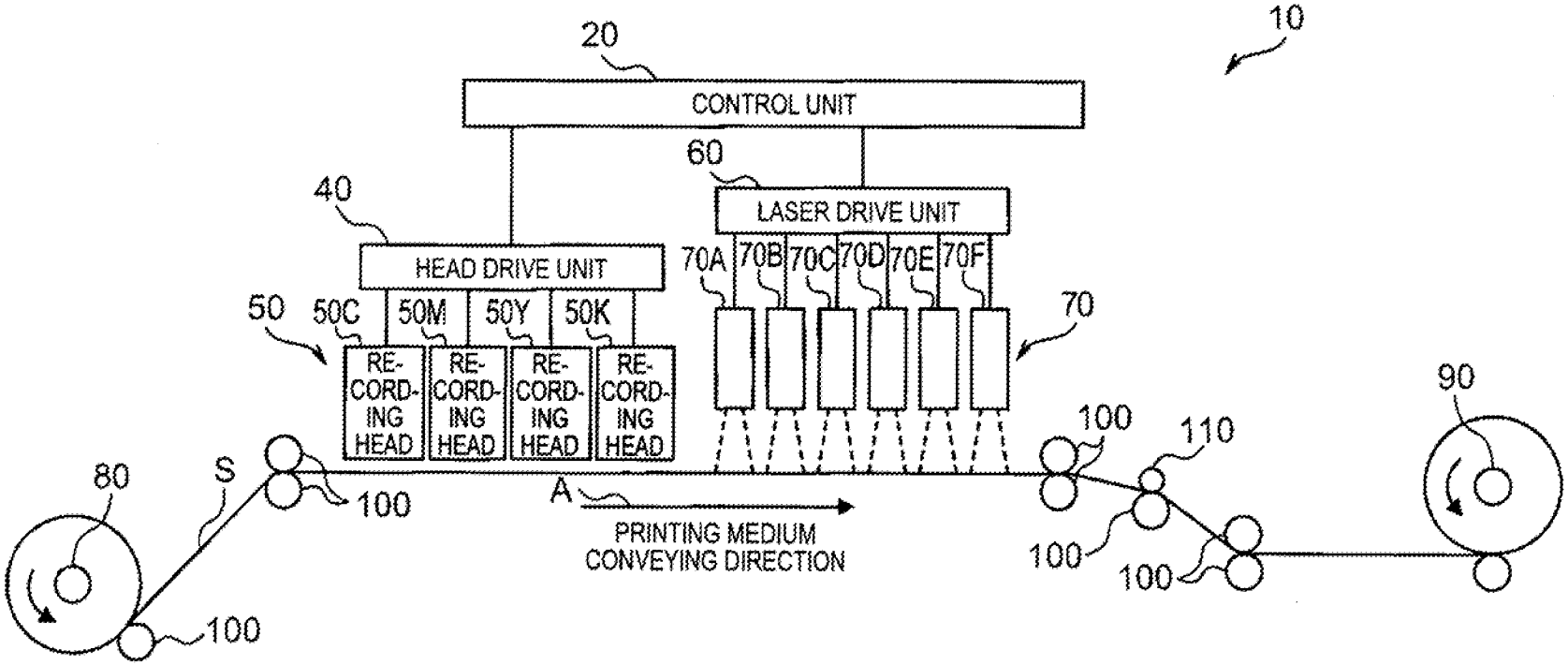
FIG. 1 schematically shows an essential configuration of printing apparatus according to respective exemplary embodiments.

10: Printing apparatus
20: Control unit
20*a*: CPU
20*b*: ROM
20*c*: RAM
20*d*: Nonvolatile memory
22: I/O interface
24: Manipulation unit
26: Display unit
28: Communication unit
40: Head drive unit
50: Recording heads
60: Laser drive unit
70: Laser drying device 70
72: Surface-emitting laser device (VCSEL)
74: Laser element
100: Conveying roller
100*a*: Roller drive unit
120A, 120B: Correspondence information
130A, 130B: Irradiation profile

DETAILED DESCRIPTION

Exemplary embodiments of the present invention will be hereinafter described in detail with reference to the accompanying drawings.

Exemplary Embodiment 1

First, a printing apparatus 10 according to a first exemplary embodiment will be described. As shown in FIG. 1, the printing apparatus 10 according to the first exemplary embodiment is equipped with a control unit 20, a head drive unit 40, recording heads 50, a laser drive unit 60, a laser drying device 70, a supply roll 80, a take-up roll 90, conveying rollers 100, and a conveyance speed detection sensor 110.

The control unit 20 controls the rotation of the conveying rollers 100 which are connected to a conveying motor by such a mechanism as gears by driving a roller drive unit 100*a* (see FIG. 4) having the conveying motor. A long, continuous sheet S (printing medium) is wound on the supply roll 80, and is pulled out and conveyed in a conveying direction A as the conveying rollers 100 are rotated.

The control unit 20 acquires image information of a print subject image for printing on the continuous sheet S and controls the head drive unit 40 on the basis of pixel-by-pixel color information included in the image information. Controlled by the control unit 20, the head drive unit 40 drives the recording heads 50 which are connected to the head drive unit 40 according to ink droplets ejecting timing that is determined on the basis of the print subject image and thereby causes the recording heads 50 to eject ink droplets (droplets)

onto the continuous sheet S being conveyed. As a result, an image corresponding to the image information is printed on the continuous sheet S being conveyed. Printing processing is performed in this manner by the printing apparatus 10.

The image information representing the print subject image is stored in a nonvolatile memory 20*d*, for example. Color information of each pixel of the image information includes information indicating a color of the pixel uniquely. Although in the exemplary embodiment the color information of each pixel of image information is represented by densities of yellow (Y), magenta (M), cyan (C), and black (K), any of other representation methods capable of representing a color of each pixel uniquely may be used.

The recording heads 50 are four recording heads 50Y, 50M, 50C, and 50K which correspond to the four respective colors Y, M, C, and K, and each recording head 50 ejects ink droplets of a corresponding color from its ink ejecting outlet. There are no limitations on the drive method for causing each recording head 50 to eject ink droplets; any of known drive methods such as a thermal method and a piezoelectric method may be employed.

Whereas general printing apparatus employ water-based inks, solvent inks with low melting temperature solvents, ultraviolet-curing inks, etc., the exemplary embodiment is directed to a case of using water-based inks. In the following description, when the term "ink" or "ink droplets" is used alone, it means a water-based ink or water-based ink droplets. Each water-based ink contains a low boiling temperature solvent (mainly formed of water) at 90 wt %, a pigment at 5 wt %, and other additives (surfactant, glycerol, etc.) at 5 wt %, and dries through evaporation of the low boiling temperature solvent.

The inks of Y, M, C, and K used in the exemplary embodiment are added with an IR (infrared) absorbent and their degrees of laser light absorption are thereby adjusted. That is, whereas the inks other than the black ink are added with the IR absorbent because they are lower in IR absorption efficiency than the black ink, the black ink need not always be added with the IR absorbent. In the exemplary embodiment, the addition amounts of the IR absorbent in the inks of the respective colors are adjusted so that the inks have the same IR absorption absorbance.

The laser drive unit 60 is equipped with switching elements such as FETs (field-effect transistors) for on/off-controlling laser elements included in each of the laser drying devices 70A-70F (hereinafter referred to as a laser drying device 70). The laser drive unit 60 adjusts the irradiation intensity of laser light emitted from each laser element by controlling the pulse duty ratio by driving the corresponding switching element under the control of the control unit 20. More specifically, the irradiation intensity of laser light becomes higher as the pulse duty ratio increases.

Figure 2:
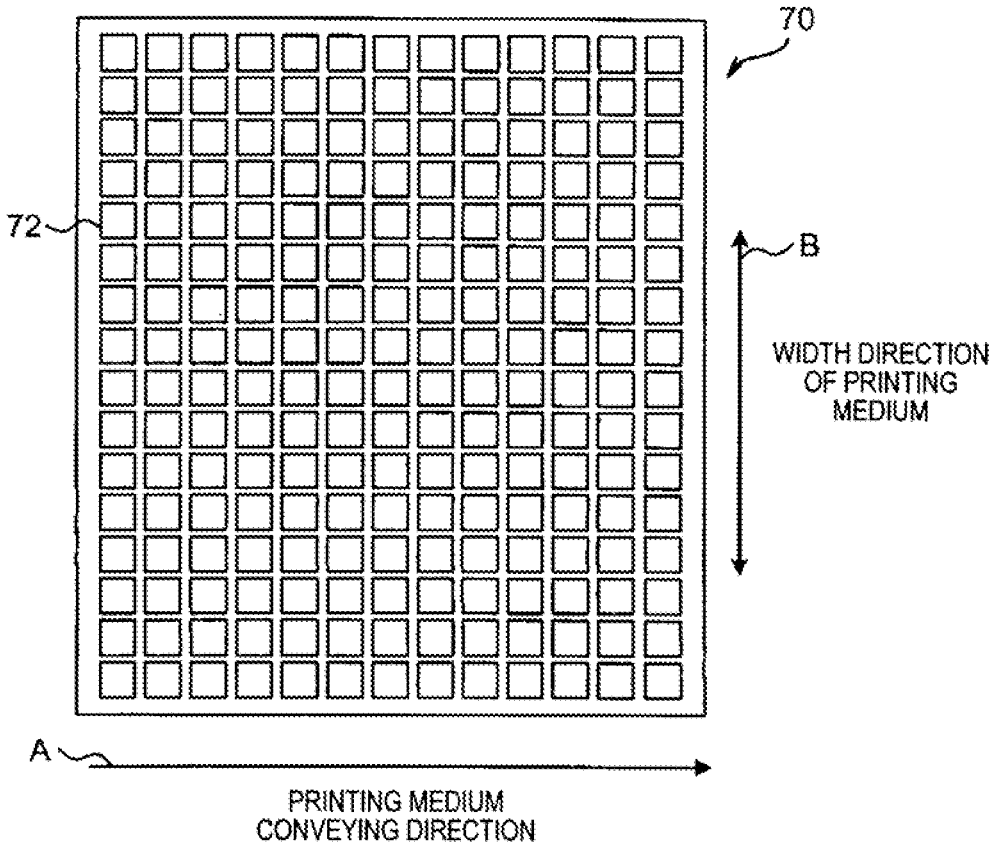
FIG. 2 is a schematic plan view showing an example arrangement of VCSELs of a laser drying device used in the printing apparatus according to the exemplary embodiments.

As shown in FIG. 2, plural surface-emitting laser devices 72 are arranged on a laser emission surface of the laser drying device 70 in lattice form in the conveying direction A and a width direction B of a continuous sheet S which is perpendicular to the conveying direction A. The laser light emission timing and the laser light irradiation intensity are controlled for each surface-emitting laser device 72 by the laser drive unit 60.

The above-described unit of driving of the laser drive unit 60 is just an example; for example, the laser drive unit 60 may drive the surface-emitting laser devices 72 in units of a laser block that includes surface-emitting laser devices 72 that are arranged in line in the conveying direction of a continuous sheet S.

Figure 3:
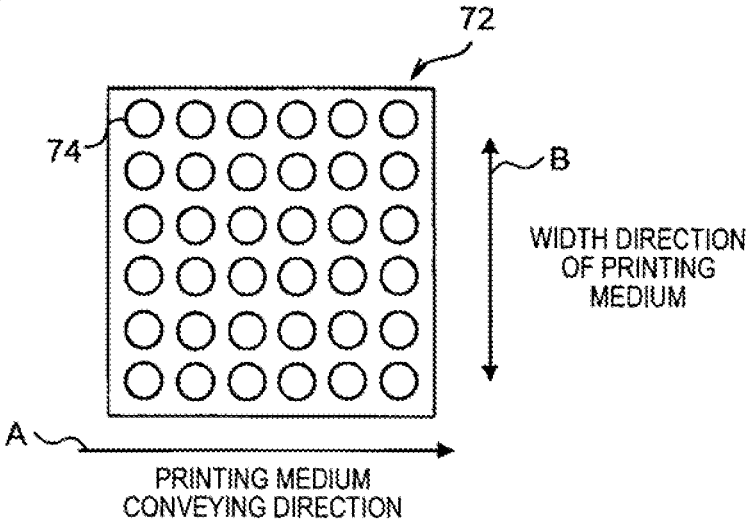
FIG. 3 is a schematic plan view showing an example arrangement of laser elements in each VCSEL of the laser drying device used in the printing apparatus according to the exemplary embodiments.

As shown in FIG. 3, each surface-emitting laser device 72, which is also called a VCSEL (vertical cavity surface-emitting laser) is a laser device in which plural vertical cavity laser elements 74 are arranged in lattice form in the conveying direction A and the width direction B. The number and the arrangement form, shown in FIG. 2, of VCSELs 72 which are arranged on the laser emission surface of the laser drying device 70 are just examples.

As described above, the plural vertical cavity laser elements 74 are arranged on the laser emission surface of each VCSEL 72 in lattice form in the conveying direction A and the width direction B. The laser elements 74 emit laser beams according to a drive control on each VCSEL 72. The number and the arrangement form, shown in FIG. 3, of laser elements 74 which are arranged in each VCSEL 72 are just examples.

By controlling the laser drive unit 60, the control unit 20 causes the laser drying device 70 to emit laser light toward the printing surface of a continuous sheet S that has been subjected to printing processing for a predetermined irradiation time and thereby dry the inks of a printed image on the continuous sheet S. As a result, the printed image on the continuous sheet S is fixed. Drying processing is performed in this manner by the printing apparatus 10.

The continuous sheet S that has been subjected to the drying processing is conveyed to the take-up roll 90 as the conveying rollers 100 are rotated and is taken up by the take-up roll 90.

Disposed, for example, at such a position as to be opposed to the printing surface of a continuous sheet S, the conveyance speed detection sensor 110 detects a conveyance speed of a continuous sheet S in the conveying direction A. The control unit 20 calculates a time when an image forming region on a continuous sheet S will be conveyed to within a laser light irradiation range of the laser drying device 70 on the basis of a conveyance speed communicated from the conveyance speed detection sensor 110 and a distance from the recording heads 50 to the laser drying device 70. Then the control unit 20 controls the laser drive unit 60 so that the inks are irradiated with laser beams emitted from the laser drying device 70 with such timing that the image forming region on the continuous sheet S is located within the laser light irradiation range of the laser drying device 70.

There are no limitations on the method by which the conveyance speed detection sensor 110 detects a conveyance speed of a continuous sheet S; any of known methods may be employed. The conveyance speed detection sensor 110 is not indispensable in the printing apparatus 10 according to the exemplary embodiment. For example, the conveyance speed detection sensor 110 may be omitted in the case where a conveyance speed of a continuous sheet S is set in advance.

Figure 4:
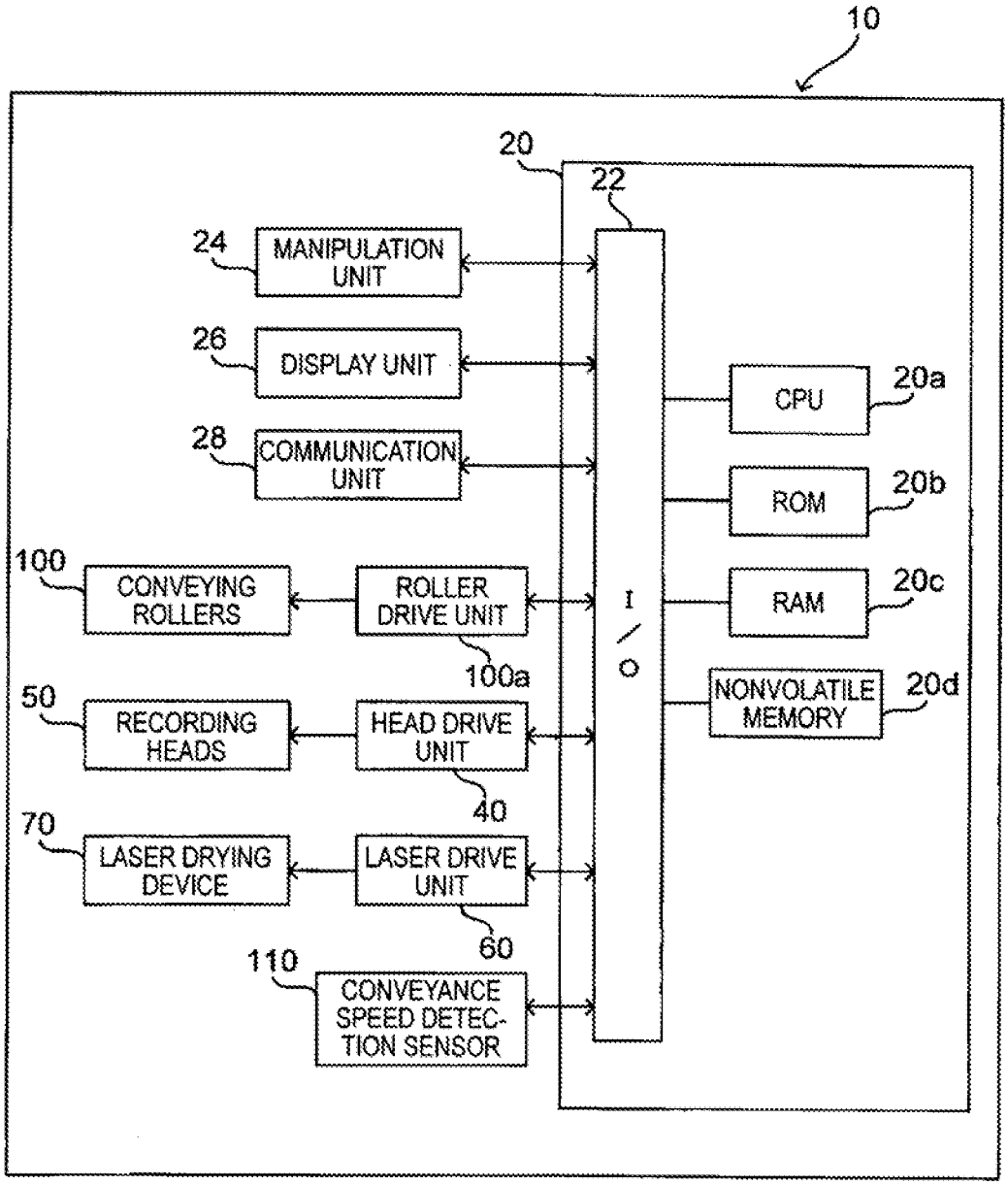
FIG. 4 is a block diagram showing an essential electrical configuration of the printing apparatus according to the exemplary embodiments.

Next, an electrical configuration of the printing apparatus 10 according to the exemplary embodiment will be described. As shown in FIG. 4, as described above, the printing apparatus 10 according to the exemplary embodiment is equipped with the control unit 20 which supervises the apparatus as a whole. The control unit 20 is equipped with a CPU (central processing unit) 20*a* which performs various kinds of processing including printing control processing (described later) and a ROM (read-only memory) 20*b* which stores programs and various kinds of information to be run or used by the CPU 20*a* in performing various kinds of processing. The control unit 20 is also equipped with a RAM (random access memory) 20*c* which temporarily stores various kinds of data as a working area of the CPU 20*a* and a nonvolatile memory 20*d* which is stored with various kinds of information to be used by the CPU 20*a* in performing various kinds of processing. The control unit 20 is further equipped with an I/O interface 22 for input and output of data from and to an external device that is connected to the printing apparatus 10.

A manipulation unit 24 to be manipulated by a user, a display unit 26 for displaying various kinds of information, and a communication unit 28 for communicating with an external device. The above-described roller drive unit 100*a*, head drive unit 40, laser drive unit 60, and conveyance speed detection sensor 110 are also connected to the I/O interface 22.

In general printing apparatus, to dry the inks efficiently after printing has been performed by ejecting ink droplets onto a printing medium, it is desirable to preferable to raise the temperature of the inks to an ink drying temperature. If the ink temperature becomes high, heat is transmitted from the inks to the printing medium, as a result of which its temperature is also increased. If the temperature of the printing medium exceeds its thermal deformation temperature, the printing medium may be deformed by heat.

The term "drying temperature" as used herein means a boiling temperature of a solvent that is used most abundantly among the ink solvents used. In the exemplary embodiment, the evaporation rate of inks is increased by raising the temperature of inks to the above their boiling temperatures.

For example, as shown in FIG. 5, where a printing medium containing a low-density polyethylene resin is used, its common heat proof temperature is 70° C. to 90° C. On the other hand, the drying temperature of a solvent ink containing a low boiling temperature solvent is about 70° C. and that of a water-based ink is about 100° C. Therefore, where solvent inks are used and laser light irradiation is controlled so that the ink temperature is raised to 70° C. which is the drying temperature of the solvent inks, the thermal deformation of a printing medium is suppressed. On the other hand, water-based inks are used and laser light irradiation is controlled so that the ink temperature is raised to 100° C. which is the drying temperature of the water-based inks, a printing medium may be deformed by heat.

In view of the above, in the printing apparatus 10 according to the invention, to suppress thermal deformation of a printing medium, in the case where the thermal deformation temperature of the printing medium is lower than or equal to the ink drying temperature, laser light irradiation is controlled so that the ink temperature is raised to a target temperature that is determined with the thermal deformation temperature of a printing medium as a reference. Furthermore, in the printing apparatus 10 according to the invention, in the case where the thermal deformation temperature of a printing medium is higher than the ink drying temperature, laser light irradiation is controlled so that the ink temperature is raised to a target temperature that is determined with the ink drying temperature as a reference.

The exemplary embodiment is directed to a case that a resin film that is prone to be deformed by heat is used as a printing medium. However, the exemplary embodiment is applicable to a case that a paper sheet is used as a printing medium because even a paper sheet coated with a resin may be rendered prone to be changed in color depending on the coating material.

It is preferable to use a printing medium that is white, of light yellow, or transparent. This is because where a printing medium that is darker than these colors is used, the printing medium itself may be heated and deformed when irradiated with laser beams emitted from the laser drying device 70.

In the exemplary embodiment, as shown in FIG. 6A, the nonvolatile memory 20*d* is stored with correspondence information 120A in which pieces of type information indicating ink types are correlated with pieces of drying temperature information indicating drying temperatures, respectively. As shown in FIG. 6B, the nonvolatile memory 20*d* is also stored with correspondence information 120B in which pieces of type information indicating printing medium types are correlated with pieces of thermal deformation temperature information indicating thermal deformation temperatures, respectively.

Furthermore, the nonvolatile memory 20*d* is stored with laser light irradiation profiles that are set for respective ink target temperatures. For example, the irradiation profiles are generated in advance by experiments. The laser drive unit 60 controls the emission intensities of the respective VCSELs 72 according to an irradiation profile.

FIGS. 7A and 7B show example irradiation profiles for ink target temperatures of 100° C. and 70° C., respectively. The ink temperature is controlled in the following manner by controlling the laser drive unit 60 according to the irradiation profile shown in FIG. 7A or 7B.

Figure 8:
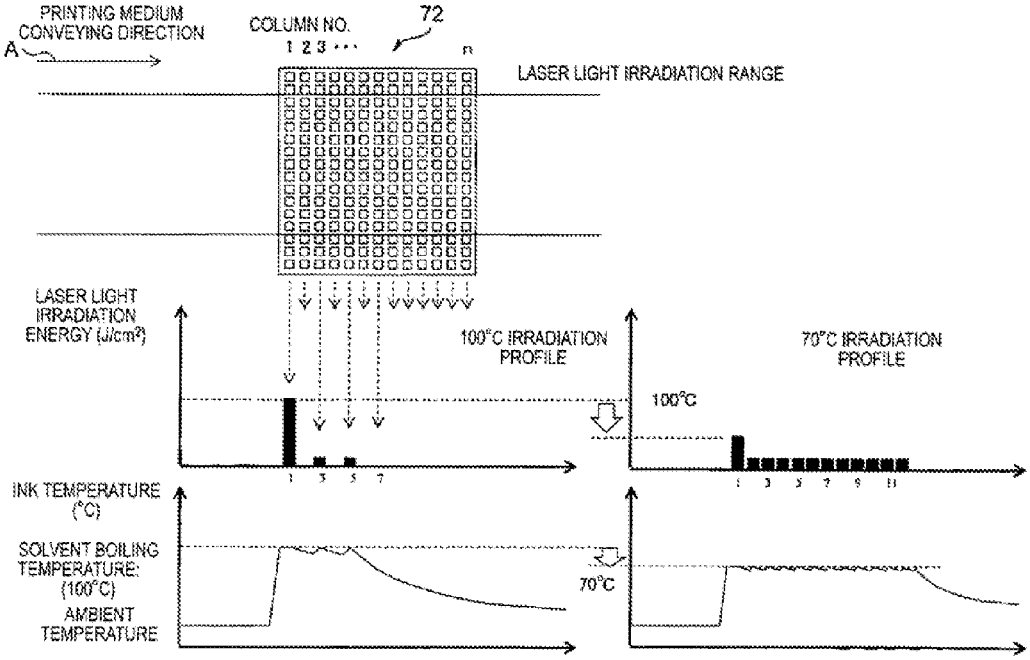
FIG. 8 is a schematic chart illustrating an example method for controlling the laser light irradiation energy in printing control processing according to a first embodiment.

As shown in FIG. 8, where the ink target temperature is set at 100° C., first, laser beams having a first irradiation energy value corresponding to the target temperature 100° C. are applied until the ink temperature is raised to 100° C. The laser light irradiation is suspended as soon as the ink temperature reaches 100° C. When the ink temperature has lowered by a predetermined temperature (e.g., 1° C.) from 100° C., laser beams having a second irradiation energy value that is smaller than the first one are applied. As soon as the ink temperature reaches 100° C. again, the laser light irradiation is suspended. In this manner, the laser drive unit 60 is controlled according to the irradiation profile for 100° C. so that the ink temperature is approximately kept at 100° C.

On the other hand, where the ink target temperature is set at 70° C., first, laser beams having a third irradiation energy value corresponding to the target temperature 70° C. are applied until the ink temperature is raised to 70° C. Laser beams having a fourth irradiation energy value that is smaller than the third one are applied thereafter. In this manner, the laser drive unit 60 is controlled according to the irradiation profile for 70° C. so that the ink temperature is approximately kept at 70° C.

Where the ink target temperature is low, the ink drying efficiency is lower and the drying takes longer time than where the ink target temperature is high. In view of this, the irradiation profiles are formed so that the total irradiation energy is constant irrespective of the ink target temperature or increases as the ink target temperature lowers.

Example methods for adjusting the total irradiation energy are a method of adjusting the laser light irradiation time and a method of adjusting the irradiation energy within the confines that a printing medium is not deformed by heat. In the exemplary embodiment, the laser drive unit 60 is controlled according to such irradiation profiles that the irradiation time of laser beams having the second or fourth irradiation energy is made longer as the ink target temperature lowers. As shown in FIG. 8, whereas the 100° C. irradiation profile is such that the VCSELs 72 of the third and fifth columns emits laser beams having the second irradiation energy, the 70° C. irradiation profile is such that the VCSELs 72 of the second to 12th columns emits laser beams having the fourth irradiation energy.

Next, a procedure that the CPU 20*a* of the printing apparatus 10 according to this exemplary embodiment follows in executing a printing control process will be described with reference to a flowchart of FIG. 9. Although in the exemplary embodiment a program of the printing control process is stored in the nonvolatile memory 20*d* in advance, the invention is not limited to such a case. For example, the program of the printing control process may be transmitted from an external device, received by the communication unit 28, and stored in the nonvolatile memory 20*d*. As a further alternative, the program of the printing control process stored in a recording medium such as a CD-ROM may be read by a CD-ROM drive or the like and taken in via the I/O interface 22.

At step S101, the CPU 20*a* controls the display unit 26 so that it displays an input picture for input of an ink type and a printing medium type. Watching the input picture, a user inputs type information including information indicating an ink type and information indicating a printing medium type by manipulating the manipulation unit 24.

At the next step S103, the CPU 20*a* judges whether type information has been input or not. If it is judged that type information has been input (S103: Y), the process moves to step S105. If it is judged that no type information has been input yet (S103: N), step S103 is executed again.

At step S105, the CPU 20*a* judges whether or not the correspondence information 120A includes drying temperature information corresponding to the ink type indicated by the received type information. If the judgment result is affirmative (S105: Y), the process moves to step S111. If the judgment result is negative (S105: N), the process moves to step S107.

At step S107, the CPU 20*a* controls the display unit 26 so that it displays an input picture for input of an ink drying temperature. Watching the input picture, the user inputs drying temperature information indicating an ink drying temperature by manipulating the manipulation unit 24.

At step S109, the CPU 20*a* judges whether drying temperature information has been input or not. If it is judged that drying temperature information has been input (S109: Y), the process moves to step S111. If it is judged that no drying temperature information has been input yet (S109: N), step S109 is executed again.

At step S111, the CPU 20*a* acquires drying temperature information corresponding to the ink type indicated by the received type information from the correspondence information 120A or the drying temperature information indicating the ink drying temperature that was input at step S109.

At the next step S113, the CPU 20*a* judges whether or not the correspondence information 120B includes thermal deformation temperature information corresponding to the printing medium type indicated by the received type information. If the judgment result is affirmative (S113: Y), the process moves to step S119. If the judgment result is negative (S113: N), the process moves to step S115.

At step S115, the CPU 20*a* controls the display unit 26 so that it displays an input picture for input of a thermal deformation temperature of a printing medium. Watching the input picture, the user inputs thermal deformation temperature information indicating a thermal deformation temperature of a printing medium by manipulating the manipulation unit 24.

At step S117, the CPU 20*a* judges whether thermal deformation temperature information has been input or not. If it is judged that thermal deformation temperature information has been input (S117: Y), the process moves to step S119. If it is judged that no thermal deformation temperature information has been input yet (S117: N), the process moves to step S117 is executed again.

At step S119, the CPU 20*a* acquires thermal deformation temperature information corresponding to the printing medium type indicated by the received type information from the correspondence information 120B or the thermal deformation temperature information indicating the thermal deformation temperature that was input at step S117.

The method for acquiring ink drying temperature information and thermal deformation temperature information of a printing medium is not limited to the above-described method. For example, where an ink type and a printing medium type are specified in advance, drying temperature information indicating the specified ink type and thermal deformation temperature information indicating the specified printing medium type may be stored in the nonvolatile memory 20*d* in advance. In this case, the CPU 20*a* acquires the stored drying temperature information and thermal deformation temperature information.

At the next step S121, the CPU 20*a* judges whether or not the thermal deformation temperature of the printing medium is higher than the ink drying temperature. If it is judged that the thermal deformation temperature of the printing medium is higher than the ink drying temperature (S121: Y), the process moves to step S123. If it is judged that the thermal deformation temperature of the printing medium is lower than or equal to the ink drying temperature (S121: N), the process moves to step S125.

At step S123, the CPU 20*a* determines an ink target temperature using the ink drying temperature as a reference and acquires an irradiation profile corresponding to the determine ink target temperature. In the exemplary embodiment, considering the fact that the ink drying efficiency increases as the ink target temperature becomes higher, if the ink drying temperature is, for example, 100° C., the CPU 20*a* sets the ink target temperature at 100° C., that is, the ink drying temperature. The method for setting an ink target temperature is not limited to this method; the ink target temperature may be set a little lower than the ink drying temperature or at a temperature that is a little higher than the ink drying temperature and does not exceed the thermal deformation temperature of the printing medium.

On the other hand, at step S125, the CPU 20*a* determines an ink target temperature using the thermal deformation temperature of the printing medium as a reference and acquires an irradiation profile corresponding to the determined ink target temperature. In the exemplary embodiment, to suppress deformation of a printing medium more reliably, if the ink drying temperature is, for example, 80° C., the CPU 20*a* sets the ink target temperature at 70° C. with a margin of a predetermined temperature (e.g., 10° C.). The method for determining an ink target temperature is not limited to this method; for example, the ink target temperature may be set at a temperature that is equal to the thermal deformation temperature of the printing medium multiplied by a positive coefficient that is smaller than 1 (e.g., 0.9).

At step S127, the CPU 20*a* controls the roller drive unit 100*a*, the head drive unit 40, and the laser drive unit 60 so as to start printing processing (described above) and drying processing that uses the irradiation profile acquired at step S123 or S125.

At the next step S129, the CPU 20*a* judges whether the printing processing and the drying processing have completed or not. If judging that the printing processing and the drying processing have not completed yet (S129: N), the CPU 20*a* continues the printing processing and the drying processing. If judging that the printing processing and the drying processing have completed (S129: Y), the CPU 20*a* finishes running the program.

Exemplary Embodiment 2

The physical configuration of a printing apparatus 10 according to a second exemplary embodiment is the same as the printing apparatus 10 according to the first exemplary embodiment, and hence descriptions therefor will be omitted.

In the first exemplary embodiment, an ink target temperature is set without taking the amount of ink used for printing into consideration. In contrast, the second exemplary embodiment is directed to a case that the ink target temperature is adjusted according to the amount of ink used for printing.

Figure 10:
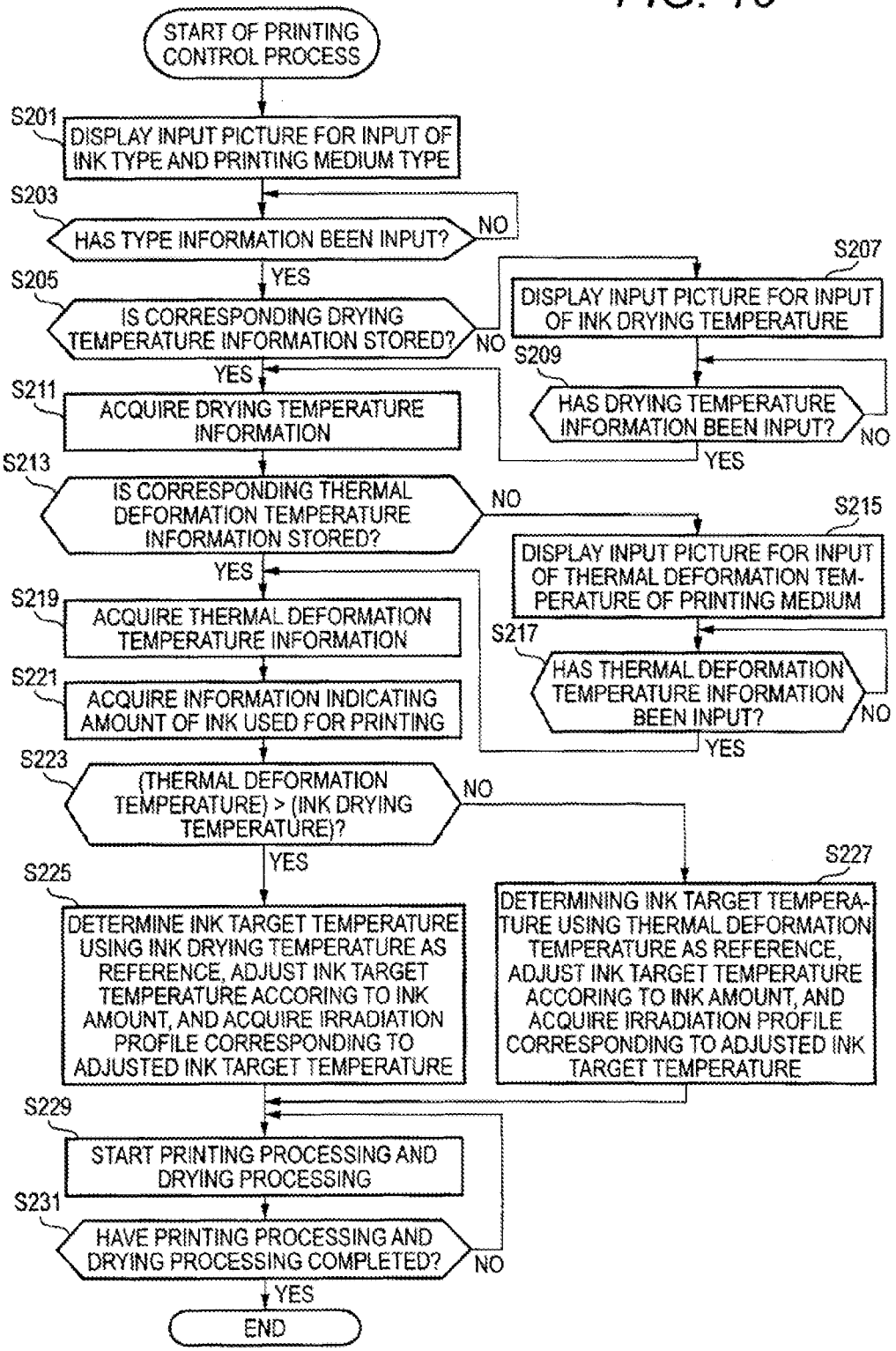
FIG. 10 is a flowchart of a procedure that a program of a printing control process according to a second exemplary embodiment follows.

Next, a procedure that the CPU 20*a* of the printing apparatus 10 according to this exemplary embodiment follows in executing a printing control process will be described with reference to a flowchart of FIG. 10. Although in the exemplary embodiment a program of the printing control process is stored in the nonvolatile memory 20*d* in advance, the invention is not limited to such a case. For example, the program of the printing control process may be transmitted from an external device, received by the communication unit 28, and stored in the nonvolatile memory 20*d*. As a further alternative, the program of the printing control process stored in a recording medium such as a CD-ROM may be read by a CD-ROM drive or the like and taken in via the I/O interface 22.

Steps S201-S219 are the same as steps S101-S119 of the first embodiment, respectively. The process moves to step S221 after execution of step S219.

At step S221, information indicating an amount of ink used for printing is acquired. In the exemplary embodiment, an amount of ink used for printing of a printing subject image is calculated on the basis of image information representing the printing subject image. For example, an amount of ink is obtained by multiplying an ink amount per pixel by the number of pixels in an image forming area of the printing subject image. Where the printing subject image is a color image, an amount of ink is calculated as the total of ink amounts of the respective colors.

At the next step S223, the CPU 20*a* judges whether or not the thermal deformation temperature of the printing medium is higher than the ink drying temperature. If the thermal deformation temperature of the printing medium is higher than the ink drying temperature (S223: Y), the process moves to step S225. If the thermal deformation temperature of the printing medium is lower than or equal to the ink drying temperature (S223: N), the process moves to step S227.

Figure 9:
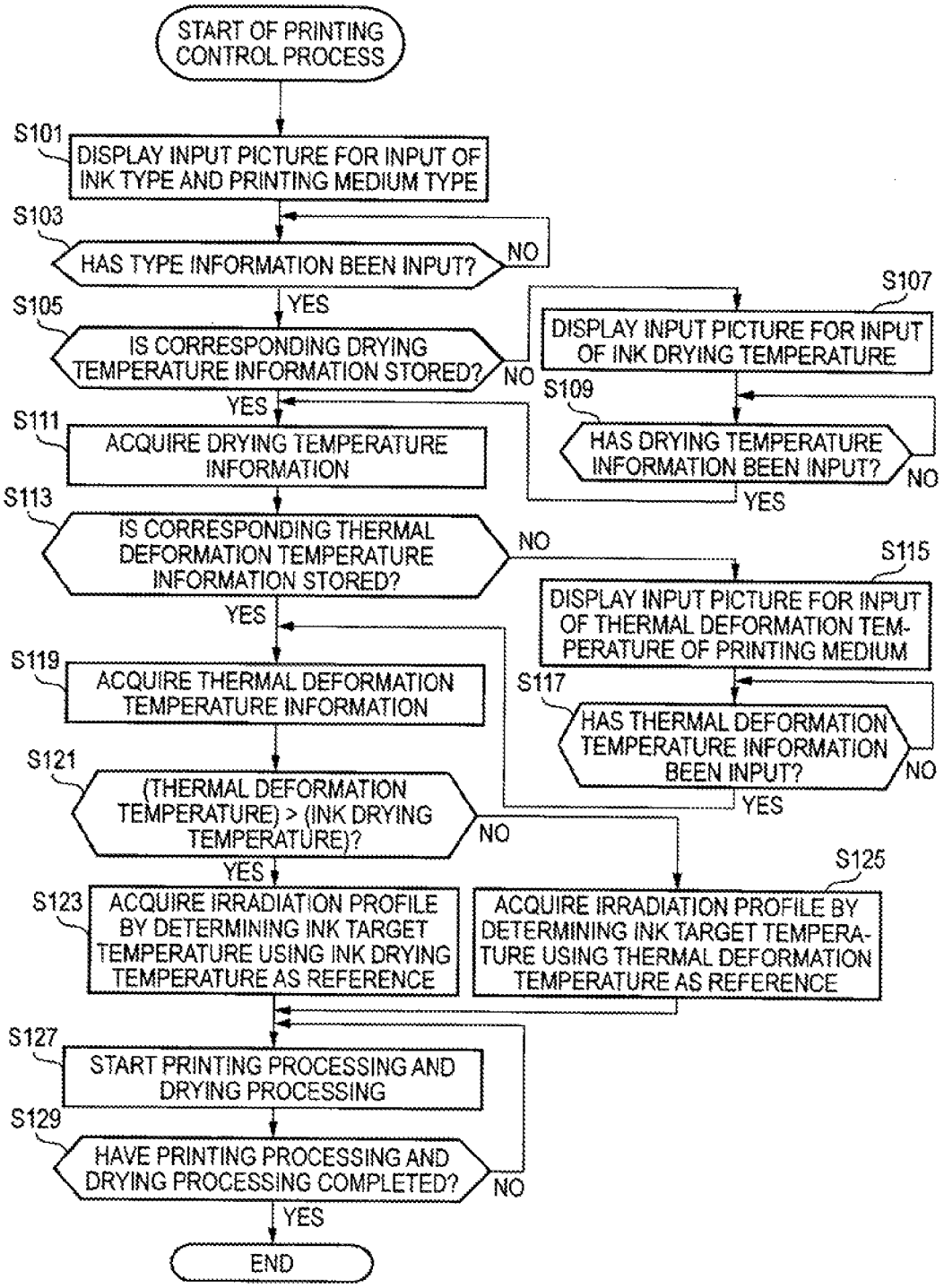
FIG. 9 is a flowchart of a procedure that a program of a printing control process according to the first exemplary embodiment follows.

At step S225, the CPU 20*a* determines an ink target temperature using the ink drying temperature as a reference as at step S123 shown in FIG. 9. Then the CPU 20*a* adjusts the ink target temperature according to the ink amount and acquires an irradiation profile corresponding to an adjusted ink target temperature. In the exemplary embodiment, if the ink amount is larger than a predetermined threshold value, the CPU 20*a* adds a predetermined temperature (e.g., 1° C.) to the ink target temperature that has been set using the ink drying temperature as a reference. For example, the threshold value is set at a lower limit value above which inks cannot be dried sufficiently with an irradiation profile corresponding to the ink target temperature. However, the method for adjusting the ink target temperature is not limited to this method; a predetermined temperature may be subtracted from the ink target temperature if the ink amount is smaller than a predetermined threshold value. As a further alternative, the ink target temperature may be set higher as the ink amount increases within the confines that the ink target temperature does not exceed the thermal deformation temperature of the printing medium.

On the other hand, at step S227, the CPU 20*a* determines an ink target temperature using the thermal deformation temperature of the printing medium as a reference as at step S125 shown in FIG. 9. Then the CPU 20*a* adjusts the ink target temperature according to the ink amount and acquires an irradiation profile corresponding to an adjusted ink target temperature. The method for adjusting the ink target temperature is similar to the one employed at step S225. The CPU 20*a* adjusts the ink target temperature within the confines that the ink target temperature does not exceed the thermal deformation temperature of the printing medium.

At step S229, the CPU 20*a* controls the roller drive unit 100*a*, the head drive unit 40, and the laser drive unit 60 so as to start printing processing (described above) and drying processing that uses the irradiation profile acquired at step S225 or S227.

At the next step S231, the CPU 20*a* judges whether the printing processing and the drying processing have completed or not. If judging that the printing processing and the drying processing have not completed yet (S231: N), the CPU 20*a* continues the printing processing and the drying processing. If judging that the printing processing and the drying processing have completed (S129: Y), the CPU 20*a* finishes running the program.

Although in the second exemplary embodiment the ink target temperature is adjusted according to the amount of ink used in printing, the invention is not limited to such a case. The laser light irradiation time may be adjusted according to the ink amount. In this case, the laser light irradiation time is adjusted so as to be made longer as the ink amount increases.

Although in the second exemplary embodiment an amount of ink used for the entire printing subject image is calculated, the invention is not limited to such a case. An ink amount may be calculated for each partial region of an image forming area. In this case, an irradiation profile may be set according to an ink amount of each partial region that corresponds to a VCSEL 72, for example. As a further alternative, an irradiation profile may be set according to an ink amount of each partial region that correspond to a column of VCSELs 72.

The laser drive unit 60 may be controlled so that no laser light shines on a non-image-forming area on a printing medium (i.e., a non-ejecting area to which no ink droplets are ejected). Also in this case, for example, switching may be made between irradiation profiles that are set according to ink amounts of respective VCSELs 72 or respective columns of VCSELs 72.

Exemplary Embodiment 3

The physical configuration of a printing apparatus 10 according to a third exemplary embodiment is the same as the printing apparatus 10 according to the first and second exemplary embodiment, and hence descriptions therefor will be omitted.

In the first and second exemplary embodiments, a printing medium is conveyed at a constant speed. In contrast, the third exemplary embodiment is directed to a case that the conveyance speed of a printing medium is varied according to the ink target temperature.

Figure 11:
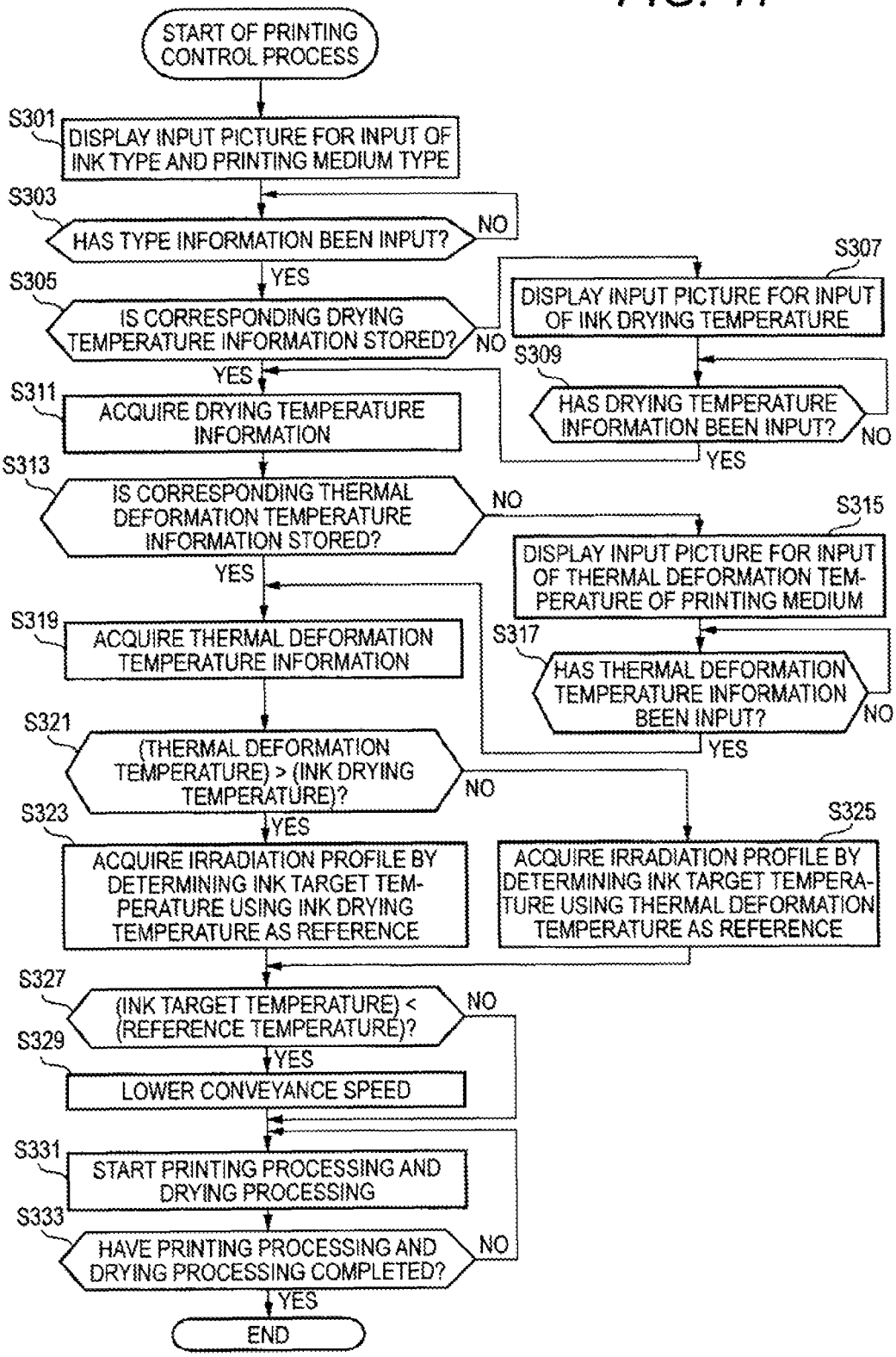
FIG. 11 is a flowchart of a procedure that a program of a printing control process according to a third exemplary embodiment follows.

Next, a procedure that the CPU 20*a* of the printing apparatus 10 according to this exemplary embodiment follows in executing a printing control process will be described with reference to a flowchart of FIG. 11. Although in the exemplary embodiment a program of the printing control process is stored in the nonvolatile memory 20*d* in advance, the invention is not limited to such a case. For example, the program of the printing control process may be transmitted from an external device, received by the communication unit 28, and stored in the nonvolatile memory 20*d*. As a further alternative, the program of the printing control process stored in a recording medium such as a CD-ROM may be read by a CD-ROM drive or the like and taken in via the I/O interface 22.

The exemplary embodiment is directed to a case that a conveyance speed of a printing medium was input through the manipulation unit 24 in advance and is stored in the nonvolatile memory 20*d* and that when printing processing and drying processing are performed a printing medium is conveyed at the stored conveyance speed.

Steps S301-S325 are the same as steps S101-S125 of the first embodiment, respectively. The process moves to step S327 after execution of step S325.

At step S327, the CPU 20*a* judges whether or not the ink target temperature is lower than a predetermined reference temperature. In the exemplary embodiment, taking into consideration drying efficiency levels at respective ink temperatures, the reference temperature is set at 70° C., for example.

If it is judged that the ink target temperature is lower than the reference temperature (S327: Y), the process moves to step S329. If the ink target temperature is higher than or equal to the reference temperature (S327: N), the process moves to step S331.

At step S329, considering that the ink drying efficiency is low because of a low ink temperature, to dry the inks more, the CPU 20*a* controls the roller drive unit 100*a* so as to lower the conveying speed of the printing medium. In the exemplary embodiment, a new conveyance speed is calculated by subtracting a predetermined speed (e.g., 50 m/min) from a current conveyance speed of the printing medium (e.g., 150 m/min). However, the method for changing the conveyance speed is not limited to this method; for example, the conveyance speed may be reduced as the ink target temperature becomes lower.

At step S331, the CPU 20*a* controls the roller drive unit 100*a*, the head drive unit 40, and the laser drive unit 60 so as to start printing processing and drying processing.

At the next step S333, the CPU 20*a* judges whether the printing processing and the drying processing have completed or not. If judging that the printing processing and the drying processing have not completed yet (S333: N), the CPU 20*a* continues the printing processing and the drying processing. If judging that the printing processing and the drying processing have completed (S333: Y), the CPU 20*a* finishes running the program.

Although the first to third exemplary embodiments are directed to the case that irradiation profiles corresponding to respective ink target temperatures are stored in the nonvolatile memory 20*d* in advance, the invention is not limited to such a case. For example, it is possible to equip the printing apparatus 10 with a temperature sensor for measuring an ink temperature and generate irradiation profiles for respective ink target temperatures while a temperature measurement is performed.

Although the first to third exemplary embodiments an irradiation profile is determined according to an ink target temperature and laser beams are emitted according to the determined irradiation profile, the invention is not limited to such a case. For example, it is possible to equip the printing apparatus 10 with a temperature sensor for measuring an ink temperature and switch from one irradiation profile to another according to a measured ink temperature.

Although the first to third exemplary embodiments are directed to the case that correspondence information 120A, correspondence information 120B, and irradiation profiles are stored in the nonvolatile memory 20*d* in advance, the invention is not limited to such a case. For example, correspondence information 120A, correspondence information 120B, and irradiation profiles may be received and acquired from an external device via the communication unit 28.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A drying device comprising:

an irradiation unit that irradiates, with laser light, a printing medium onto which ink droplet have been ejected from a droplets ejecting unit; and a control unit that controls the irradiation unit to dry the ink on the printing medium; wherein the control unit includes a nonvolatile memory storing ink drying temperatures correlated with ink types and thermal deformation temperatures correlated with printing medium types, the control unit acquires from the nonvolatile memory an ink drying temperature corresponding to the ink and a thermal deformation temperature corresponding to the printing medium, the control unit determines an ink target temperature using the thermal deformation temperature of the printing medium as a reference in a case in which the thermal deformation temperature of the printing medium is lower than or equal to the ink drying temperature, and using the ink drying temperature as a reference in a case in which the thermal deformation temperature of the printing medium is higher than the ink drying temperature, and the control unit controls the irradiation it so that a temperature of the ink on the printing medium becomes the ink target temperature.

2. The drying device according to claim 1, wherein the control unit controls the irradiation unit so that total energy of laser light that is applied in the case where the thermal deformation temperature of the printing medium is lower than or equal to the ink drying temperature is higher than total energy of laser light that is applied in the case where the thermal deformation temperature of the printing medium is higher than the ink drying temperature.

3. The drying device according to claim 1, wherein the control unit controls the irradiation unit so that an irradiation time of laser light that is applied in the case where the thermal deformation temperature of the printing medium is lower than or equal to the ink drying temperature is longer than an irradiation time of laser light that is applied in the case where the thermal deformation temperature of the printing medium is higher than the ink drying temperature.

4. The drying device according to claim 1, wherein the control unit calculates an amount of ink droplets ejected onto the printing medium using image information representing a printing subject image for printing on the printing medium, and controls the irradiation unit so that the total energy of laser light applied becomes higher as the calculated amount of ink droplets increases.

5. The drying device according to claim 4, wherein the control unit calculate amounts of ink droplets ejected onto the printing medium for respective divisional regions of the printing medium, and controls the irradiation unit so that total energy of laser light applied to each of the divisional regions becomes higher as the calculated amount of ink droplets applied to the divisional region increases.

6. The drying device according to claim 1, further comprising a reception unit that receives information indicating a type of the printing medium, wherein the control unit acquires thermal deformation information that is correlated with the received printing medium type using correspondence information indicating a corresponding relationship between printing medium types and thermal deformation temperatures.

7. The drying device according to claim 1, wherein the control unit acquires a laser light irradiation profile corresponding to the ink target temperature and controls the irradiation unit according to the acquired irradiation profile.

8. The drying device according to claim 1, wherein the control unit determines a non-image-forming area of the printing medium using image information representing a printing subject image for printing on the printing medium, and controls the irradiation unit so that the determined non-image-forming area is not irradiated with laser light.

9. A printing apparatus comprising:

a droplets ejecting unit that ejects ink droplets; and the drying device according to claim 1.

10. The printing apparatus according to claim 9, further comprising a conveying mechanism that conveys the printing medium at a predetermined conveyance speed while the printing medium is irradiated with laser light, wherein the control unit controls the conveying mechanism so that the conveyance speed is lower in a case that the thermal deformation temperature of the printing medium is lower than or equal to the ink drying temperature than in a case that the thermal deformation temperate of the printing medium is higher than the ink drying temperature.

11. A non-transitory computer readable medium storing a program causing a computer to function as the control unit of the drying device according to claim 1.

* * * * *